United States Patent [19]

Caldwell

[11] 3,970,061

[45] July 20, 1976

[54] CONTROL SYSTEM FOR EXHAUST GAS RECIRCULATING VALVE

[75] Inventor: Roland B. Caldwell, Worthington, Ohio

[73] Assignee: Ranco Incorporated, Columbus, Ohio

[22] Filed: Mar. 7, 1975

[21] Appl. No.: 556,558

Related U.S. Application Data

[63] Continuation of Ser. No. 447,767, March 4, 1974, abandoned, which is a continuation-in-part of Ser. No. 320,126, Jan. 2, 1973, abandoned.

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,739,797 | 6/1973 | Caldwell | 123/119 A |
| 3,818,880 | 6/1974 | Dawson et al. | 123/119 A |
| 3,884,200 | 5/1975 | Caldwell | 123/119 A |
| 3,915,136 | 10/1975 | Caldwell | 123/119 A |

*Primary Examiner*—Wendell E. Burns
*Attorney, Agent, or Firm*—Watts, Hoffmann, Fischer & Heinke Co.

[57] ABSTRACT

An exhaust gas recirculation control system for an internal combustion engine is disclosed in which a pressure operated exhaust gas recirculation (EGR) valve governs the flow of engine exhaust gas into the engine intake. The EGR valve is supplied with operating pressure from the engine intake manifold via a pressure amplifier. The amplifier has a pressure input which tends to vary in relation to the flow rate of gas through the engine so that the EGR valve operating pressure varies as an amplified function of the amplifier input pressure signal. A control valve modifies the amplifier input signal as a function of intake manifold pressure to enable the EGR valve operation to be programmed as desired throughout the range of operation of the engine.

11 Claims, 1 Drawing Figure

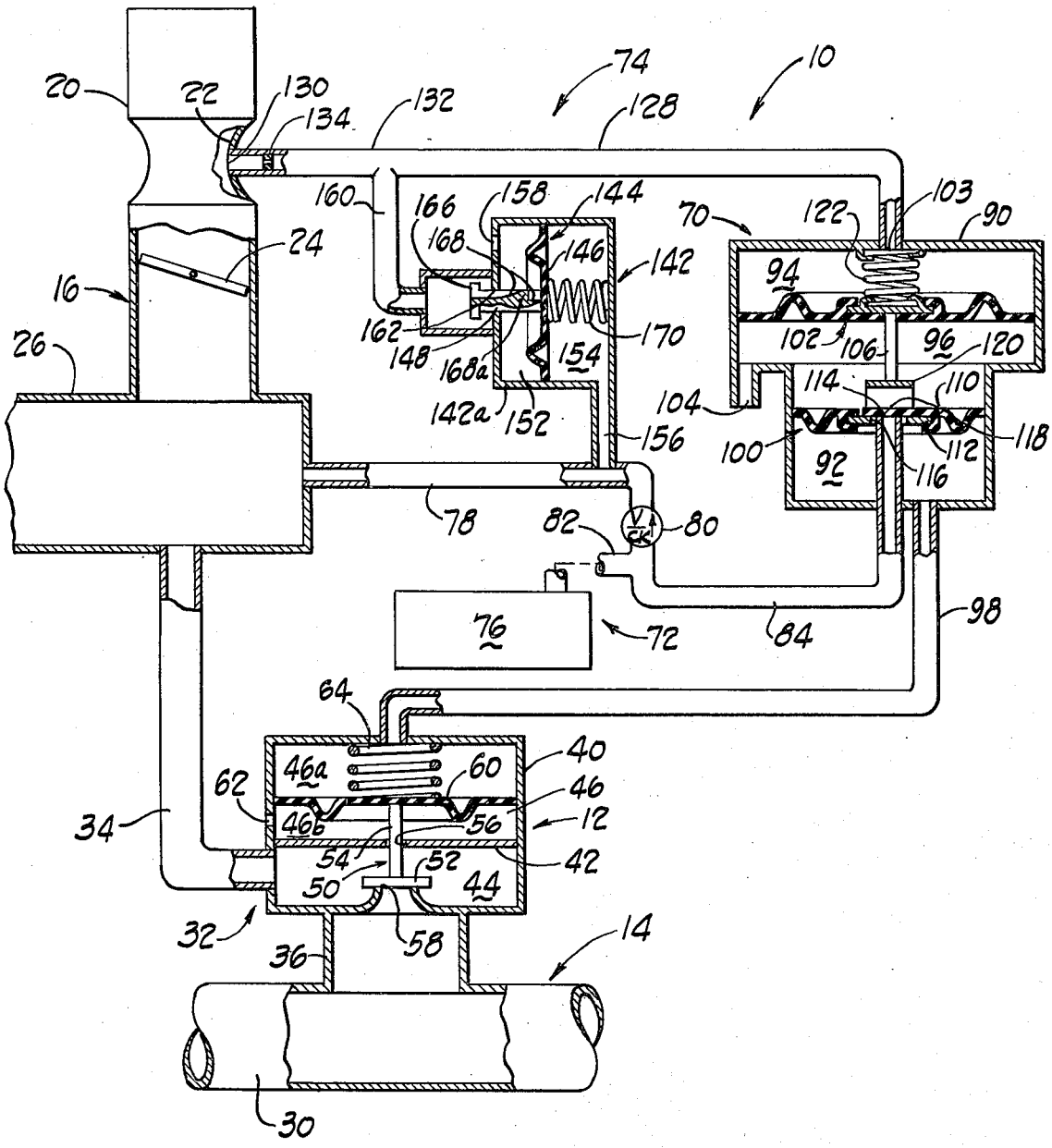
20
22
130
134
132
74
128
10
160
166
158
144
168
146
142
162
148
168a
170
154
142a
152
156
70
122
103
90
94
102
106
96
120
114
110
104
100
92
112
118
116
24
16
26
78
82
80
76
72
84
98
64
46a
60
40
62
46
46b
56
12
34
54
52
42
50
44
32
58
36
14
30

CONTROL SYSTEM FOR EXHAUST GAS RECIRCULATING VALVE

RELATED APPLICATIONS

This application is a continuation of U.S. application Ser. No. 447,767 filed Mar. 4, 1974, now abandoned, which in turn was a continuation-in-part of U.S. application Ser. No. 320,126 filed Jan. 2, 1973, now abandoned.

BACKGROUND OF THE INVENTION

Field of the Invention

The present invention relates to an improved system for controlling the recirculation of exhaust gases through an internal combustion engine to reduce or eliminate nitrous oxide emissions.

In U.S. Pat. No. 3,739,797 issued June 19, 1973 to Roland B. Caldwell, a pressure operated valve is provided for controlling the recirculation of engine exhaust gas back in to the engine intake manifold. The EGR valve is operated by pressure furnished from the intake manifold through a pressure regulator which regulates the valve operating pressure according to the flow rate of gas through the engine, preferably as indicated by the vacuum pressure established at a carburetor venturi. The regulator generally functions as a pressure amplifier in that the EGR valve operating pressure communicated to the EGR valve from the intake manifold varies as an amplified function of the input pressure signal derived from the carburetor venturi.

It is desirable to recirculate controlled flows of exhaust gas into the engine intake to provide optimum mixtures of air, fuel and exhaust gas flowing into the engine during various conditions of operation of the engine for minimizing the nitrous oxide content of the engine emissions. While the prior art systems have been quite successful in minimizing objectionable emissions by recirculating exhaust gas into the engine induction systems, the proportions of exhaust gas and air-fuel mixtures have not always been optimized for various operating conditions of the engines.

Most EGR valves are disposed in a crossover passage between the engine exhaust gas system and the intake air induction system. The pressure differential between the exhaust gas and the induction air varies according to the operating conditions of the engine and for this reason, with a given opening of the EGR valve, the flow of recirculated exhaust gas through the crossover passage varies according to the pressure differential between the intake and exhaust gas. This is particularly true in automotive vehicle engines which are operated at varying speeds and loads.

For example, when the engine is operating at a low cruising speed without a particularly great load, the throttle is positioned so that a relatively large magnitude vacuum pressure is present in the intake manifold while only a moderate regulator input signal pressure is provided. Under such conditions a moderate EGR valve operating pressure is produced by the regulator and the EGR valve positioned between its fully opened and fully closed positions to produced a theoretically moderate flow of recirculating exhaust gas as indicated by the level of the input pressure signal. However, because of the relatively large pressure differential between the exhaust and intake manifolds, the flow of exhaust gas through the EGR valve may be in excess of that required to produce an optimum mixture of air-fuel charge and recirculated exhaust gas.

When an engine is operated under a heavy load at relatively low speed, the regulator input pressure signal level may not be significantly greater than the input pressure signal level developed when the engine is operated at cruising speed under normal load; however, a substantial flow of recirculated exhaust gas through the EGR valve is normally required. Under this condition of engine operation the intake manifold pressure is of relatively low magnitude relative to atmospheric pressure and the pressure differential between the exhaust gas and the intake manifold may be sufficiently small that an inadequate flow of exhaust gas is recirculated when the EGR valve is in the open position dictated solely by the regulator input pressure signal. In such circumstances, in order to optimize the proportions of the air-fuel mixture and the recirculated exhaust gas flow, the EGR valve would have to be opened wider than its theoretical opening dictated by the input fluid signal.

As the engine speed approaches a wide open throttle condition when operating at high speed and/or under substantial load, the recirculation of exhaust gas should properly be terminated in accordance with predetermined intake manifold pressure characteristics since under substantially wide open throttle conditions, nitrous oxide is not produced as a combustion product and recirculation of exhaust gas is not necessary.

SUMMARY OF THE INVENTION

The present invention provides a system for recirculating exhaust gas to the intake of the internal combustion engine which enables the volume of recirculated exhaust gas to be programmed as desired throughout the operating range of the engine to optimize the proportions of air-fuel mixture and recirculated exhaust gas entering the engine combustion chambers.

In a preferred and illustrated embodiment of the invention, a pressure operated EGR valve is disposed in a cross-over duct between the engine exhaust system and the engine gas induction system. The EGR valve is communicated to a valve operating pressure source, formed by the engine intake manifold and a vacuum reservoir, through a pressure regulator. The pressure regulator governs the extent of the operating pressure communicated to the EGR valve from the source as an amplified function of a regulator input pressure signal provided by a signal source.

The signal source is constructed and arranged so that the regulator input pressure signal is programmed to vary as a combined function of gas flow rate through the engine and intake manifold pressure. The preferred signal source includes a pressure signal transmitting conduit between the regulator input and a venturi in a carburetor of the engine. Venturi vacuum pressure varies as a function of the engine intake air flow rate, is indicative of engine speed and load conditions and is communicable to the regulator input via the signal conduit. Intake manifold pressure variations are indicative of engine load and of the differential pressure between the exhaust duct and the intake manifold applied across the EGR valve in the cross-over duct.

The signal source also includes a control valve for modifying the pressure in the signal conduit in accordance with sensed intake manifold pressure so that the resultant input pressure to the regulator varies, throughout the operating range of the engine, as a programmed function of gas flow through the engine and intake manifold pressure. This enables the EGR valve to be positioned for permitting desirable recirculating exhaust gas flow rates in terms of engine speed and load as well as the pressure differential applied across the EGR valve in the cross-over duct.

In a preferred embodiment of the invention, the control valve variably communicates the signal conduit to a substantially constant pressure source, such as atmospheric air pressure, thus altering the fluid signal level in the conduit in accordance with operation of the control valve. The control valve is communicable with the engine air induction system and is operated in response to intake manifold pressure.

The control valve preferably includes a valve member which is movable in response to changes in intake manifold pressure and which is configured to variably communicate the signal conduit to atmosphere as desired throughout its range of movement thus enabling the EGR valve to govern the amount of exhaust gas recirculation throughout the operating range of the engine in a pre-programmed manner.

An important object of the invention is the provision of a new and improved exhaust gas recirculation valve controlling system wherein the operation of a pressure responsive EGR valve is governed by a pressure regulator which in turn is governed as a programmed function of engine speed and engine loading.

Other objects and advantages of the present invention will become apparent from the following detailed description made with reference to the accompanying drawing which forms a part of the specification and illustrates an EGR valve controlling system embodying the invention.

DESCRIPTION OF A PREFERRED EMBODIMENT

The drawing illustrates a system 10 for controlling operation of a fluid pressure operated exhaust gas recirculating (EGR) valve 12 associated with an internal combustion engine (shown in part) of an automotive vehicle. The EGR valve 12 governs the flow of engine exhaust gas from an engine exhaust system, partly illustrated by the reference character 14, into an engine gas induction system 16 under predetermined engine operating conditions to reduce or eliminate nitrous oxide emissions from the engine.

The induction system 16 directs combustion air and mixed air and fuel into the combustion chambers of the engine and comprises a conventional carburetor 20, shown schematically, having a throat defining a venturi section 22 and a movable throttle valve 24 downstream from the venturi section, and an intake manifold 26, shown in part, for distributing the air-fuel mixture from the carburetor to the combustion chambers.

The exhaust gas system 14 comprises an exhaust duct 30 (which may be the engine exhaust manifold) and a cross-over duct arrangement 32 including first and second passages 34, 36 through which exhaust gas can flow to the intake manifold.

The EGR valve 12 is disposed between the passages 34, 36 to control the flow of recirculated exhuast gas to the intake manifold. The valve 12 comprises a housing 40 containing a transverse partition plate 42 which defines, within the housing a valve chamber 44 and a valve operating chamber 46. The passages 34, 36 extend to the valve chamber 44 from the intake manifold 26 and the exhaust duct 30, respectively.

A valving member 50 is movably supported in the housing 40 for opening and closing communication between the passages 34, 36 via the chamber 44. The valving member 50 comprises a valve head 52 disposed in the chamber 44 and a stem 54 extending from the head 52 into the valve operating chamber 46 through a stem guiding opening 56 in the partition 42. The valving member 50 reciprocates in the chamber 44 to move the head 52 into and away from engagement with a valve seat 58 formed by the valve housing. When the valve head 52 closes on the seat 58 flow to the chamber 44 via the passage 36 is blocked. As the head 52 moves away from the seat the flow area through which exhaust gas is recirculated to the intake manifold progressively increases.

In the preferred embodiment of the invention, the EGR valve is operated to vary the exhaust gas recirculation according to differential pressure levels established in the valve operating chamber 46. The valve operating chamber 46 contains an air impervious flexible diaphragm 60 (schematically shown) which extends across the chamber 46 and sealingly engages the housing wall to define chamber sections **46*a*, 46*b*. The valve stem 54 is connected to the diaphragm 60 so that when the diaphragm 60 flexes the valving member 50** is moved with respect to the valve housing.

In the preferred construction controlled differential pressures are established across the diaphragm 60 to govern the position of the valving member 50. The chamber section **46*a* is communicated with atmospheric air pressure via a port 62 in the housing wall so that the pressure in the chamber section is substantially constant. The clearance between the stem 54 and the guide opening 56 is slight, and its flow area is small compared to the area of the port 62 so that the chamber section 46*b* remains at atmospheric air pressure regardless of the pressure in the valve chamber 44.**

The chamber section **46*a* is communicable with controlled vacuum pressure so that the diaphragm 60 tends to flex in a direction away from the partition plate 42 as the magnitude of the vacuum pressure in the chamber section 46*a* increases. A compression spring 64 is disposed in the chamber section 46*a* and reacts between the diaphragm 60 and the valve housing to bias the valving member towards its closed position. The EGR valve is thus positively closed until the valve operating differential pressure force acting on the diaphragm 60 is sufficient to overcome the force of the spring 60** and open the valve.

It should be appreciated that the flow rate of exhaust gas through the port 58, at any given EGR valve opening position, varies according to the magnitude of the pressure difference between the gas in the passage 36 and the pressure in the chamber 44, passage 34 and intake manifold 26. Hence when the exhaust gas back pressure is large compared to the intake manifold pressure a greater flow rate of exhaust gas passes to the intake manifold at a given EGR valve open position then when the exhaust gas back pressure is only slightly greater than the intake manifold pressure.

The system 10 functions to govern the EGR valve operating pressure differential as a programmed function of engine speed and engine load. In the preferred embodiment of the invention the system 10 comprises a pressure amplifier, or regulator, 70 for variably communicating valve operating pressure to the valve 12 from a valve operating pressure source 72 under the control of the input fluid signal source 74. The signal source 74 provides an input fluid signal to the regulator 70 which varies as a programmed function of engine speed and engine load and the level of operating pressure communicated to the EGR valve 12 from the pressure source 72 thus varies as a function of the input signal. The regulator input signal is programmed so that the EGR valve is positioned to anticipate exhaust gas flow pressure differentials across the valve (which may vary according to engine operating conditions) to optimize the flow rate of recirculated exhaust gas passing through the EGR valve under the extant engine operating conditions.

In a preferred embodiment of the invention, the valve operating pressure source 72 produces a relatively steady state vacuum pressure and is defined by the intake manifold 26 and a coacting pressure reservoir 76. The intake manifold 26 communicates with the reservoir 76 via a conduit section 78, a check valve 80 disposed in the conduit section 78, and a conduit section 82 extending from the conduit section 78 to the reservoir 76. The check valve 80 is oriented so that air flow from the reservoir 76 to the intake manifold 26 can freely occur, but air flow from the intake manifold 26 to the reservoir 76 is blocked. Accordingly, the intake manifold 26 is effective to evacuate the reservoir 76 and the reservoir tends to remain evacuated when the magnitude of the vacuum pressure in the manifold 26 is less than the magnitude of the vacuum in the reservoir 76. The reservoir 76 and manifold 26 thus cooperate to provide a relatively constant source of valve operating pressure which is communicated to the regulator 70 via a conduit section 84.

In the preferred embodiment of the invention, the reservoir 76 has a relatively large volume and provides a substantially constant source of operating pressure for the valve 12 even when the engine is operated for relatively long periods of time under heavy load at close to its wide open throttle condition. Such circumstances occur, for example, when an automobile is required to ascend a long grade resulting in the engine being operated at a cruising speed but under heavy load. When this occurs, the vacuum pressure magnitude in the intake manifold is reduced relative to atmospheric pressure yet exhaust gas recirculation is required and the reservoir 76 provides an adequate vacuum source for maintaining the EGR valve open. The large reservoir volume insures that the reservoir is not gradually vented by normal leakage of the system components.

The reservoir 76 could have a relatively small volume for preventing the loss of EGR valve operating source pressure when the throttle is momentarily wide open. With minimal system leakage, such a reservoir could provide EGR valve operating vacuum for a sustained period.

In the preferred embodiment, the regulator 70 comprises a housing 90 which defines an output pressure chamber 92, an input signal pressure chamber 94, and a constant pressure chamber 96 which is preferably maintained at atmospheric air pressure. The output pressure chamber 92 is communicated with the valve operating chamber section 46*a* of the EGR valve via an output conduit 98 so that the regulator output pressure established in the chamber 92 governs the differential pressure created across the valve operating diaphragm 60 of the EGR valve. The output chamber 92 is defined within the housing 90 by a flexible valving diaphragm assembly 100 which extends across the inside of the housing and is sealingly connected about its periphery to the housing wall.

The input chamber 94 is defined within the housing by a flexible air-impervious diaphragm assembly 102 which extends across the interior of the housing and is sealingly engaged with the housing wall about is periphery. The input chamber 94 communicates with the input signal source 74 via a signal port 103 formed in the housing 90 so that the pressure in the chamber 94 remains the same as the signal pressure provided by the source 74. When the pressure in the input chamber 94 changes, the diaphragm assembly 102 flexes.

The constant pressure chamber 96 is defined within the housing 90 between the diaphragm assemblies 100, 102 and is communicated with atmospheric air pressure via a vent 104. The vent 104 enables the chamber 96 to remain at atmospheric pressure so that a substantially constant pressure is applied to the diaphragm assemblies 100, 102 by the air in the chamber 96.

The diaphragm assemblies 100, 102 are interconnected by a link 106 so that flexing movement of the diaphragm assembly 102 causes flexing movement of the valve diaphragm assembly 100. When the magnitude of the input pressure signal to the chamber 94 increases relative to atmosphere, i.e. when the magnitude of the vacuum pressure input signal increases, the diaphragm assembly 102 flexes in a direction away from the output chamber 92 as a result of the differential pressure force acting on the diaphragm assembly 102 between the chambers 96 and 94. When the diaphragm assembly 102 is so moved, the linkage 106 causes the valve diaphragm assembly 100 to follow the movement of the assembly 102 and increase the vacuum level in the output chamber 92 by an amount equal to a predetermined multiple of the change in level of the input signal pressure.

When the input signal pressure level is reduced in magnitude relative to atmospheric pressure, the atmospheric pressure in the chamber section 96 urges the valving diaphragm assembly 100 in a direction away from the input chamber 94 causing the level of the pressure established in the output chamber 92 to be reduced by an amount equal to a predetermined multiple of the change in the input signal level pressure.

In the preferred embodiment, the valving diaphragm assembly 100 comprises a flexible diaphragm member 110 which carries an annular washer member 112 on the side of the diaphragm facing the chamber 92. A source vacuum port 114 is defined by the end of the conduit 84 extending into the chamber 92 in alignment with a central opening 116 in the washer 112. The central portion of the diaphragm member 110 is cut to define a flap-like tonque 118 which is hinged to the diaphragm member and extends over the opening 116 in the washer 112 and the vacuum source port 114.

The link 106 preferably includes a yoke portion 120 which extends through the diaphragm 110 on opposite sides of the tongue 118 and is connected to the washer 112. The periphery of the washer 112 is securely fastened to the diaphragm so that the diaphragm 110 and the washer 112 are moved as a unit with the link 106 and the yoke 120.

When the link 106 is moved in a direction away from the chamber 92 the diaphragm tongue 118 seals against the washer 112 about the opening 116 so that atmospheric air from the chamber 96 cannot enter the output chamber 92. At the same time, the washer 112 moves the tongue 118 away from the source vacuum port 114, exposing the output chamber 92 to the source vacuum pressure and causing the level of the pressure in the output chamber 92 to increase in magnitude towards the magnitude of the source pressure level.

When the link member 106 moves toward the chamber 92, the diaphragm tongue 118 engages the seals against the source vacuum port 114 to block communication of source pressure to the chamber 92. Continued movement of the link 106 causes the washer 112 to move towards the chamber 92 relative to the tongue 118 resulting in communication of atmospheric air pressure to the chamber 92 through the washer opening 116 from the chamber 96. This reduces the magnitude of the valve operating output vacuum in the chamber 92 relative to atmospheric pressure. The pressure in the chamber 96 remains at atmospheric pressure because of an inflow of atmospheric air to the chamber 96 through the vent 104.

The relative areas of the diaphragm assemblies 100, 102 determine the amplification ratio of the regulator 70. If, for example, the pressure area of the diaphragm assembly 102 is 10 times the pressure area of the diaphragm valve assembly 100, the regulator amplification ratio is 10 to 1, i.e. for any given increment of signal pressure level change, the output pressure level in the chamber 92 is changed by an amount 10 times larger than the incremental change in the input signal pressure level.

When the vacuum pressure level in the chamber 92 approximates a predetermined multiple of the magnitude of the signal level in the chamber 94, the forces acting on the diaphragm assemblies 100, 102 are balanced and the diaphragm valve assembly 100 is positioned so that the tongue 118 seals both the source vacuum port 114 and the washer opening 116. The pressure in the output chamber 92 remains stable so long as the input signal pressure level remains stable. Changes in the input signal level result in slight imbalances in the pressure forces acting on the diaphragm assemblies causing the pressure in the chamber 92 to be altered accordingly until the forces acting on the diaphragm assemblies are again balanced.

In the illustrated embodiment of the invention, a tension spring 122 is disposed in the input chamber 94 and reacts between the diaphragm assembly 102 and the housing 90 to bias the diaphragm assembly 102 away from the output chamber 92 when no input signal is present in the chamber 94 (i.e. when the chamber 94 is at atmospheric pressure). The spring 122 thus establishes a predetermined, initial, low level vacuum pressure output from the regulator 70. As the magnitude of the input signal level increases from atmospheric pressure, indicating an increase in engine speed and/or load, the vacuum in the input chamber 94 increases causing the regulator output vacuum level to increase from the initial output level as an amplified function of the increase in input signal level. When the input signal level to the regulator 70 reaches a predetermined level, for example when the engine is operating at a low cruising speed, more then adequate power for opening the EGR valve 12 from the regulator output chamber 92 is assured.

For a more detailed description of the operation of a regulator like the regulator 70, reference should be made to the disclosure in U.S. Pat. No. 3,739,797 and U.S. Pat. No. 3,125,111.

The input fluid signal source 74 provides a regulator input vacuum signal which is communicated to the regulator 70 via a signal conduit 128. The regulator input signal varies as a function of engine speed and engine load. The signal source 74 is preferably constructed to produce a fluid pressure signal indicative of the flow rate of gas through the engine (which varies according to engine speed and load), which signal is altered in response to detected intake manifold pressure levels (generally indicative of the engine load). In the preferred embodiment of the invention the source 74 comprises a pressure sensing port 130 which communicates with the throat of the carburetor venturi section 22 and which communicates the induction air pressure in the venturi throat to a signal conduit section 132 via a flow restrictor 134; and a signal control valve 140 for variably communicating the signal conduit section 132 to a source of relatively constant pressure, such as atmospheric air pressure, in response to intake manifold pressure. The resultant input signal level in the conduit section 128 varies as a combined function of induction air flow rate and intake manifold pressure.

In the preferred embodiment of the invention, the signal control valve 140 comprises a valve body 142 containing a diaphragm valving assembly 144 which is actuated in response to changes in intake manifold pressure. The valving assembly 144 comprises a flexible air impervious diaphragm 146 which extends across the interior of the valve body 142 and carries a valve plunger 148. The diaphragm 146 is sealed to the interior of the valve body about its periphery so that separate chambers 152, 154 are defined within the body 142 on opposite sides of the diaphragm.

The chamber 154 is communicated to intake manifold pressure via a conduit 156 which, in the preferred embodiment, extends from the chamber 154 to the conduit 78 at a location between the check valve 80 and the intake manifold 26. The chamber 152 communicates with atmospheric air pressure via a vent port 158 defined in an end wall **142*a* of the valve housing so that the diaphragm 146** flexes in response to changes in intake manifold pressure.

The chamber 152 also communicates with the signal conduit section 132 via a conduit 160, and a port 162 which is defined in the end wall **142*a*. The valve plunger 148 is preferably formed by a cylindrical plunger body which extends through and is closely surrounded by the port 162. The projecting end of the plunger body terminates in a radially extending end flange 166 which is disposed beyond the end wall 142*a* and limits movement of the valve plunger 148 into the valve body. A narrow variable depth slot 168 is formed in the plunger body to extend along the longitudinal extend of the plunger body and through the end flange 166**.

The valving member 144 is normally biased towards a position in which the valve plunger 148 projects a maximum distance through the port 162 by a compression spring 170 which is disposed in the chamber 154 and reacts between the body 142 and the diaphragm 146.

When the engine intake manifold pressure is substantially at atmospheric pressure, i.e. when the engine is not operating or when the engine is operating at wide open throttle, the compression spring 170 maintains the plunger 148 in its fully projecting position. As the engine intake manifold vacuum increases in magnitude, the magnitude of the vacuum pressure in the valve chamber 154 increases relative to the atmospheric pressure in the chamber 152 causing the valve plunger 148 to move into the body 142 through the port 162 toward its limit position. As the plunger 148 moves through the port 162, the conduit 160 is variably communicated to the atmospheric air in the chamber 154 via the plunger slot 168.

The pressure sensing port 130 produces a static vacuum pressure signal in the conduit section 136 which varies according to the velocity pressure of the induction air flowing through the carburetor. When the induction air flow rate increases, the velocity pressure vacuum at the venturi throat increases correspondingly and vice-versa. The flow restrictor 134 assures that when the signal controlling valve 140 vents the conduit 160 to reduce the input signal to the regulator 70 the flow of atmospheric air into the venturi throat via the port 130 is minimized.

The plunger slot 168 is configured to enable a preprogrammed flow of recirculating exhaust gas through the EGR valve. When the engine is operated at idle speed, the throttle valve is substantially closed causing the intake manifold vacuum level to be relatively high. This results in the plunger 148 moving into the housing 142, but since there is substantially no input signal from the carburetor venturi, the EGR valve remains closed. The valve 140 is illustrated in its condition when the engine is idling.

When the engine is speeded up to a low cruising speed, the intake manifold vacuum increases somewhat and is then continuously reduced towards atmospheric pressure as the engine speed continues to increase from low cruising speed under a normal load (i.e. when the vehicle is operated on a level roadway and not transporting an abnormal load). When the engine reaches the low speed cruising condition with a normal engine load the throttle is partly opened so that a venturi vacuum signal is present in the conduit section 136. This signal, of itself, is sufficiently great to cause the EGR valve 12 to open appreciably. The intake manifold vacuum level is also substantial so that the differential pressure across the EGR valving member 50 tends to create a substantial flow of recirculating exhaust gas through the EGR valve.

The control valve 140 enables a restricted flow of atmospheric air into the conduit section 136 to reduce the level of the venturi vacuum signal so that the composite regulator input signal in the conduit 128 provides an EGR valve opening which is reduced compared to that which would be provided solely by the venturi vacuum signal. The intake manifold vacuum at the low speed cruise condition moves the plunger 148 into the housing 142 so that the plunger slot 168 enables atmospheric air to flow to the conduit 136 via the port 162 and slot 168 from the chamber 154. This reduces the venturi vacuum signal level and provides a composite regulator input signal level to position EGR valving member 50 to anticipate the relatively larger exhaust gas flow pressure through the cross-over ducting 32. The flow rate of recirculated exhaust gas is thus optimized for the low speed cruise condition of the engine.

As the engine speed increases under normal load, the plunger 148 moves outwardly from the body 142 through the port 162 as the intake manifold pressure level is progressively reduced. This progressively reduces the flow of atmospheric air to the conduit 136 due to the gradual reduction in the depth of the slot 168. The increased engine speed increases the level of the signal pressure produced by the port 130. The combined effects of the increasing level of the signal from the carburetor venturi and the progressively diminishing venting of the conduit section 136 to atmosphere via the valve 140 open the EGR valve to anticipate the reduction in exhaust gas flow pressure across the EGR valving member 50 so that the flow of exhaust gas through the EGR valve is optimized for the particular speed at which the engine is operating.

When the engine is operated at high speed and at nearly wide open throttle, the reduction in intake manifold pressure level is such that the intake manifold pressure rather closely approaches atmospheric pressure. At this condition of operation the plunger 148 is positioned with respect to the port 162 so that communication between the conduit 136 and atmospheric air pressure via the control valve 140 is blocked. As shown in the drawing the slot 168 defines a land portion 168*a* which is flush with the periphery of the plunger 148. Under the noted condition of operation of the engine the land 168*a* is aligned with the port 162 to prevent the valve 140 from the venting the conduit section 136 and diminishing the venturi vacuum signal level. The EGR valve is consequently opened to an extend determined solely by the venturi pressure level and enables recirculation of substantial exhaust gas even though the pressure differential across the EGR valving member 50, which creates the flow of exhaust gas to the intake manifold, is small due to the low level intake manifold pressure.

Similarly, when the engine is operated under heavy loads and the throttle is close to its wide open position the valve 140 blocks communication between atmosphere and the signal conduit section 136 regardless of the engine speed. Under such conditions the slot land 168*a* is alinged with the port 162 to block venting of the conduit section 136 and the EGR valving member is opened to the maximum extend permitted by the venturi vacuum signal. The flow of exhaust gas through the EGR valve is thus maximized for the existing engine speed.

When the engine is substantially at wide open throttle and the intake manifold vacuum level is reduced to a predetermined low level, for example three inches of mercury or less, the plunger 148 projects fully through the port 162 and the depth of the slot 168 aligned with the port 162 is maximum. The plunger 148 is so positioned whether the engine is operating at close to its maximum speed or at a lower speed under extreme load. The resultant signal pressure level in the signal conduit 128 is substantially at atmospheric pressure, notwithstanding relatively large magnitude vacuum signals provided by the port 130 if the engine is operating at high speed. The EGR valve is thus closed since exhaust gas recirculation if no longer necessary.

While a single embodiment of the invention has been illustrated and described in detail, the invention is not to be considered limited to the precise construction shown. Various modifications, adaptations and uses of the invention may occur to those skilled in the art and the intention is to cover all such adaptations, modifications and uses which fall within the scope of the appended claims.

What is claimed is:

1. In a system for controlling the flow of exhaust gases from the exhaust system into the intake gas induction system of an internal combustion engine including a fuid operated valve to control said recirculating exhaust gas flow, fluid pressure source means providing a source of valve operating pressure, a fluid pressure regulator for controlling operating fluid pressure applied to said valve from said fluid pressure source to thereby control operation of said valve, fluid signal source means for providing an input fluid signal to said regulator, said signal source means comprising structure for producing a fluid signal which varies as a function of the flow rate of gas through the engine and control means responsive to pressure in the intake manifold of the engine to modify said fluid signal to provide said input fluid signal to which said regulator responds.

2. A system as claimed in claim 1 wherein said regulator comprises an input fluid signal chamber, said fluid signal source means communicates said input fluid signal to said chamber, and said control means comprises a signal control valve communicable with said fluid signal produced by said signal source means structure and actuated in response to pressure conditions in the intake manifold for modifying the level of the fluid signal.

3. A system as claimed in claim 2 wherein said signal control valve is operated to controllably communicate said fluid signal to atmospheric pressure whereby the fluid signal is modified.

4. In a system as claimed in claim 3 wherein said signal control valve comprises a valve member and a valve port, said valve member movable relative to said port to govern communication between atmospheric pressure and said signal source means structure, and a valve member actuator responsive to pressure in said intake manifold to vary the position of said movable valve member.

5. In a system as defined in claim 4 wherein said control valve member defines a surface portion configured to provide communication of atmospheric pressure to said signal source means as a predetermined function of intake manifold pressure.

6. In a system as defined in claim 5 wherein said signal control valve member and said valve port are related to prevent said fluid operated valve from recirculating exhaust gas when the engine operates at wide open throttle.

7. A method of controlling the flow of exhaust gas recirculated from an engine exhaust system to an engine intake gas induction system comprising:

a. providing a crossover duct arrangement between said exhaust system and said intake system;

b. providing a valve means including a movable valving member in said crossover ducting to provide for controllable variable flow area communication between said exhaust system and said intake system;

c. sensing the flow rate of gas through the engine and producing fluid signals in response to sensed gas flow rates;

d. sensing the pressure in an intake manifold of the intake system and altering the fluid signal produced from sensing the gas flow rate through the engine in accordance with the sensed intake manifold pressure; and, e. positioning the valving member according to the level of the altered fluid signal so that the valving member is positioned to at least partly anticipate the exhaust gas flow producing pressure established across the exhaust gas flow area provided by said valving member.

8. The method of claimed in claim 6 further including providing a source of operating pressure effective to move said valving member, maintaining the magnitude of said operating pressure at a level which exceeds a predetermined multiple of the level of said altered signal, and variably communicating said valve means to said source of operating pressure to apply valving member operating pressure for moving said valving member which varies as an amplified function of the altered signal.

9. In a system for controlling the flow of exhaust gases from an exhaust system into the intake gas induction system of an internal combustion engine including a fluid operated valve to control said recirculating exhaust gas flow, fluid pressure source means providing a source of valve operating pressure, a fluid pressure regulator for controllably transmitting valve operating fluid pressure to said valve from said fluid pressure source to thereby control operation of said valve, fluid signal responsive means for operating said regulator so that the valve operating pressure transmitted by said regulator varies in accordance with operation of said signal responsive means, first signal means comprising structure for producing a fluid signal which varies as a function of the flow rate of gas through the engine, and second signal means for producing a fluid signal which varies in accordance with changes in an operating condition of the engine, said first and second signal means cooperating to govern operation of said signal responsive means.

10. The system claimed in claim 9 wherein said second signal means comprises a member movable in response to changes in magnitude of pressure in an intake manifold of said engine.

11. A method of controlling the flow of exhaust gases from an exhaust system into an induction system of an internal combustion engine comprising:

a. controllably communicating the exhaust and intake systems by a pressure operated valve;

b. supplying operating pressure to the valve via a pressure regulator;

c. producing first and second fluid signals which are continuously variable according to sensed changes in operating conditions of the engine, one of said signals varying in accordance with variations in the flow of gas through the engine; and, d. operating said regulator by said first and second signals so that the valve operating output pressure of said regulator is altered in relation to variations in both said first and second fluid signals.

* * * * *